US012397333B2

(12) United States Patent
Liu et al.

(10) Patent No.: US 12,397,333 B2
(45) Date of Patent: Aug. 26, 2025

(54) SKEW ROLLING ASSEMBLY AND METHOD SUITABLE FOR LARGE-SIZE SUPERALLOY BARS

(71) Applicant: Anhui Hangon Precise Rolling Co. Ltd, Anhui (CN)

(72) Inventors: Dong Liu, Anhui (CN); Zhe Zhang, Anhui (CN); Jianguo Wang, Anhui (CN)

(73) Assignee: Anhui Hangon Precise Rolling Co. Ltd, Suzhou (CN)

( * ) Notice: Subject to any disclaimer, the term of this patent is extended or adjusted under 35 U.S.C. 154(b) by 261 days.

(21) Appl. No.: 18/144,826

(22) Filed: May 8, 2023

(65) Prior Publication Data

US 2024/0189879 A1 Jun. 13, 2024

(30) Foreign Application Priority Data

Dec. 7, 2022 (CN) ..... 202211561942.8

(51) Int. Cl.
*B21B 1/02* (2006.01)

(52) U.S. Cl.
CPC ..... *B21B 1/026* (2013.01); *B21B 2203/187* (2013.01); *B21B 2263/02* (2013.01); *B21B 2267/06* (2013.01); *B21B 2267/18* (2013.01)

(58) Field of Classification Search
CPC ..... B21B 1/20; B21B 1/16; B21B 13/008; B21B 19/12; B21B 19/16; B21B 27/025; B21D 19/02; B21D 19/04; B21D 19/06
See application file for complete search history.

(56) References Cited

U.S. PATENT DOCUMENTS

2015/0306646 A1* 10/2015 Yamane ..... B21B 19/04 72/97
2017/0001225 A1* 1/2017 Hayashi ..... B21B 19/04
2020/0276624 A1* 9/2020 Liu ..... B21B 27/025
2023/0054014 A1* 2/2023 Shimoda ..... B21B 19/02

* cited by examiner

*Primary Examiner* — Debra M Sullivan
(74) *Attorney, Agent, or Firm* — CM Law PLLC; Robert C. Klinger

(57) ABSTRACT

Disclosed is a skew rolling assembly suitable for large-size superalloy bars, including four rollers with completely identical shape and size, where the four rollers are all active rollers. In the production process, the four rollers play a role in promoting the forward flow of blank metal in a rolling direction, thus avoiding a rolling jamming phenomenon caused by the obstruction of guide plates to the forward flow of the blank in the rolling process of the prior art. The providing of the four rollers improves the rolling speed and increases the degree of deformation. Disclosed is a skew rolling method suitable for large-size superalloy bars. By utilizing the skew rolling assembly suitable for the large-size superalloy bars, and utilizing four rotating active rollers for the skew-rolling forming of bars, the rolling speed is improved, the problem that the cooperative rolling of two rollers and guide plates in the prior art is prone to the phenomenon of rolling jamming is avoided, the forming quality is guaranteed, the rolling production efficiency is improved, and the degree of deformation is increased.

10 Claims, 4 Drawing Sheets

SKEW ROLLING ASSEMBLY AND METHOD SUITABLE FOR LARGE-SIZE SUPERALLOY BARS

CROSS-REFERENCE TO RELATED APPLICATION

This patent application claims the benefit and priority of Chinese Patent Application No. 202211561942.8 filed with the China National Intellectual Property Administration on Dec. 7, 2022, the disclosure of which is incorporated by reference herein in its entirety as part of the present application.

TECHNICAL FIELD

The present disclosure relates to the technical field of skew rolling of bars, and in particular to a skew rolling assembly and method suitable for large-size superalloy bars.

BACKGROUND

Large-size superalloy ultrafine-grained bars have a great potential in industrial application fields. However, there are two problems in the preparation process of ultrafine-grained superalloys mentioned in existing patents or papers: (1) At present, the preparation of ultrafine-grained materials by severe plastic deformation technology has developed rapidly, but the five mainstream methods, i.e., high pressure torsion (HPT), equal-channel angular pressing (ECAP), accumulative roller bonding (ARB), multidirectional forging (MF) and torsional extrusion (TE), have the following problems: High pressure torsion (HPT) and equal channel angular extrusion (ECAP) have large molding load, and the existing molding equipment generally does not have the loading capacity of industrialized large-size products, so the sizes of finished products are small. Accumulative roller bonding (ARB) is poor in deformation permeability and thus can only be used for thin plate preparation. Multi-directional forging (MF) is poor in deformation uniformity and small in effective deformation zone. Torsional extrusion (TE) has the deformation zone in millimeter scale, and is impossible to prepare large-size bulk ultrafine-grained materials. (2) When a skew rolling mode of two rollers+two guide plates is used for preparation, two rollers are active deformation tools, which make the blank advance spirally and promote the metal to flow forward in the rolling direction, and two stationary guide plates can improve the dimensional accuracy of the rolled bars, but the friction between the two guide plates and the blank obstructs the forward flow of the metal in the rolling direction. For example, in the prior art with publication number CN109772890A and CN108277446B, a method for preparing ultrafine-grained superalloy bar is disclosed, which also employs rolling tools of rollers and guide plates.

When large-size deformation is carried out, with the decrease of cross-sectional area of the deformation zone, redundant metals are generated and expand towards the direction of the guide plate, the metals make contact with the guide plate and generate friction resistance, and gradually fill the clearances between the blank and the guide plate and then flow to the gap between the guide plate and the roller; meanwhile, the metal in contact with the guide plate dissipates heat quickly, and its fluidity becomes worse with the decrease of temperature, which eventually leads to the phenomenon of rolling jamming that the blank only rotates but does not advance or neither rotates nor advances in the rolling process, the production efficiency is reduced, and mold wear is increased.

Therefore, how to change the current situation that the rolling method for large-size superalloy bars in the prior art is prone to the phenomenon of rolling jamming and leads to low rolling efficiency has become an urgent problem to be solved by those skilled in the art.

SUMMARY

An objective of the present disclosure is to provide a skew rolling assembly and method suitable for large-size superalloy bars, so as to solve the problems existing in the prior art, avoid the phenomenon of rolling jamming to the maximum extent, increase the degree of deformation, and improve the rolling production efficiency of the large-size superalloy bars.

To achieve the objective above, the present disclosure provides the following technical solution: a skew rolling assembly suitable for large-size superalloy bars includes:

- four rollers capable of rotating actively, where the rollers each are of an unequal-diameter rotary body structure;
- a straight line where a moving direction of a blank during rolling is located is used as a rolling line, and the four rollers are uniformly distributed around a circumferential direction of the rolling line.

Preferably, the four rollers have the same size.

Preferably, the ends having a large diameter of the four rollers are uniformly distributed around the rolling line to form a feed end of the blank.

Preferably, the roller includes a first truncated cone, a second truncated cone, a third truncated cone and a fourth truncated cone which are arranged coaxially and connected in sequence. An axial length ratio of the first truncated cone to the second truncated cone to the third truncated cone to the fourth truncated cone is 3:1:1:1, a roller surface cone angle of the first truncated cone is from 3 degrees to 4.5 degrees, a roller surface cone angle of the second truncated cone is from 3 degrees to 4 degrees, a roller surface cone angle of the third truncated cone is from 2 degrees to 3.5 degrees, a roller surface cone angle of the fourth truncated cone is from 1 degree to 3.5 degrees, and a rolling angle of the roller is from 5 degrees to 7 degrees.

Preferably, a ratio of a throat diameter of the roller to a diameter of the blank is from 1.0 to 5.0, and a ratio of an axial length of the roller to the throat diameter of the roller is from 3.0 to 7.0.

Preferably, a region enclosed by the four rollers is a deformation zone, and a spacing between the opposite rollers is adjustable.

In a plane perpendicular to the rolling line, a spacing ratio of two pairs of rollers arranged at intervals is ellipticity, and the ellipticity in any plane perpendicular to the rolling line in the deformation zone is equal, and the ellipticity is from 1.0 to 1.1.

In the deformation zone, a feeding angle is from 7 degrees to 9 degrees, the rolling angle is from 5 degrees to 7 degrees, the rotating speed of the roller is from 10 r/min to 11 r/min, and the diameter reduction rate is from 60% to 70%.

A skew rolling method suitable for large-size superalloy bars is further provided by the present disclosure, which uses above skew rolling assembly suitable for large-size superalloy bars. The four rollers all rotate around respective axes, and the heated blank enters the deformation zone enclosed by the four rollers for variable cross-section rolling, first-pass forward rolling.

Preferably, after the first-pass forward rolling is completed, rotation directions of the four rollers and the spacing between the rollers are adjusted for second-pass reverse rolling, the forward rolling and the reverse rolling are repeated until the rolling is completed, and then the blank is cooled.

The blank is heated to 915° C. to 1,115° C., the heating time is T, the unit is min, and $T=D_b\times(0.6\text{-}0.8)$, where $D_b$ is the diameter of the blank, and the unit is mm.

Compared with the prior art, the present disclosure has the following technical effects:

A skew rolling assembly suitable for large-size superalloy bars provided by the present disclosure employs four rollers of the same structure, the four rollers are all active rollers. In the production process, the four rollers play a role in promoting the forward flow of blank metal in a rolling direction, thus avoiding the phenomenon of rolling jamming caused by the obstruction of the guide plate to the forward flow of the blank in the rolling process of the prior art. The providing of the four rollers improves the rolling speed. In addition, by adjusting the rotation directions of the four rollers and the spacing between the rollers, multi-pass reciprocating rolling can be achieved, the degree of deformation is increased, and the rolling production efficiency of the large-size superalloy bars is further improved.

A skew rolling method suitable for large-size superalloy bars is further provided by the present disclosure, which uses the skew rolling assembly suitable for large-size superalloy bars above. The four rollers all rotate around respective axes, and the heated blank enters the region enclosed by the four rollers for first-pass forward rolling. In this process, the ends having a larger diameter of the four rollers can form a feed end. By using the skew rolling method suitable for large-size superalloy bars, as the blank is only in partial contact with the roller, the forming load is lower than that of the traditional severe plastic deformation. By utilizing four rotating active rollers for the skew-rolling forming of bars, the rolling speed is improved, the problem that the cooperative rolling of two rollers and guide plates in the prior art is prone to the phenomenon of rolling jamming is avoided, the degree of deformation is increased, the forming quality is guaranteed, and the rolling production efficiency is improved.

BRIEF DESCRIPTION OF THE DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and those of ordinary skill in the art may still derive other drawings from these accompanying drawings without creative efforts.

Figure 1:
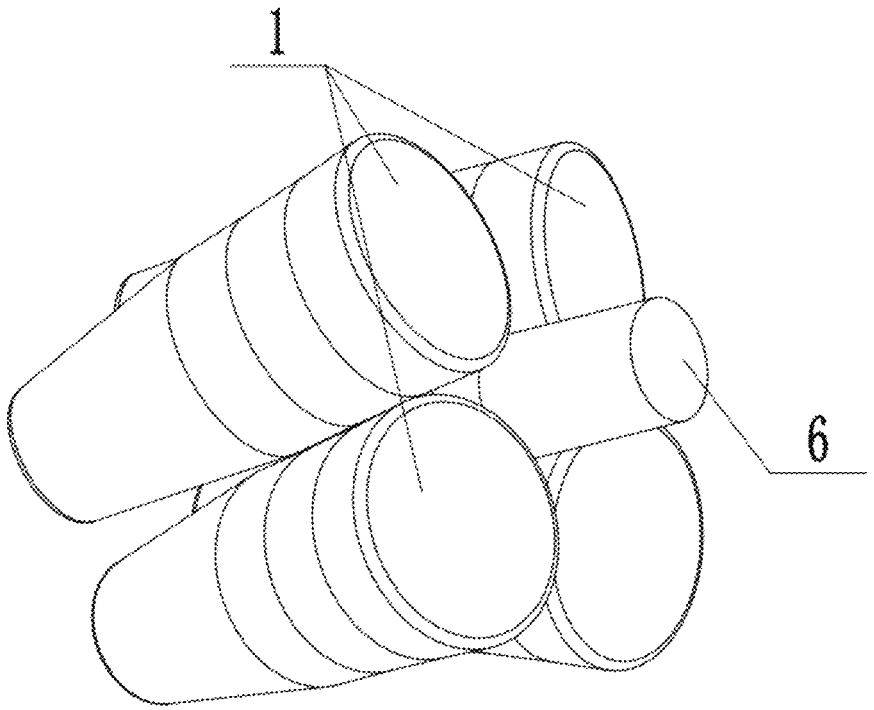
FIG. 1 is a structural schematic diagram of a skew rolling assembly suitable for large-size superalloy bars according to the present disclosure.

In the drawings: 1—roller; 2—first truncated cone; 3—second truncated cone; 4—third truncated cone; 5—fourth truncated cone; 6—blank;

$\alpha$—rolling angle; $\gamma_1$—roller surface cone angle of first truncated cone; $\gamma_2$—roller surface cone angle of second truncated cone; $\gamma_3$—roller surface cone angle of third truncated cone; $\gamma_4$—roller surface cone angle of fourth truncated cone; L1—axial length of first truncated cone; L2—axial length of second truncated cone; L3—axial length of third truncated cone; L4—axial length of fourth truncated cone; R1—throat radius of roller.

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the protection scope of the present disclosure.

An objective of the present disclosure is to provide a skew rolling assembly and method suitable for large-size superalloy bars, so as to solve the problems existing in the prior art, avoid the phenomenon of rolling jamming to the maximum extent, increase the degree of deformation, and improve the rolling production efficiency of the large-size superalloy bars.

To make the objectives, features and advantages of the present disclosure more apparently and understandably, the following further describes the present disclosure in detail with reference to the accompanying drawings and the specific embodiments.

Figure 2:
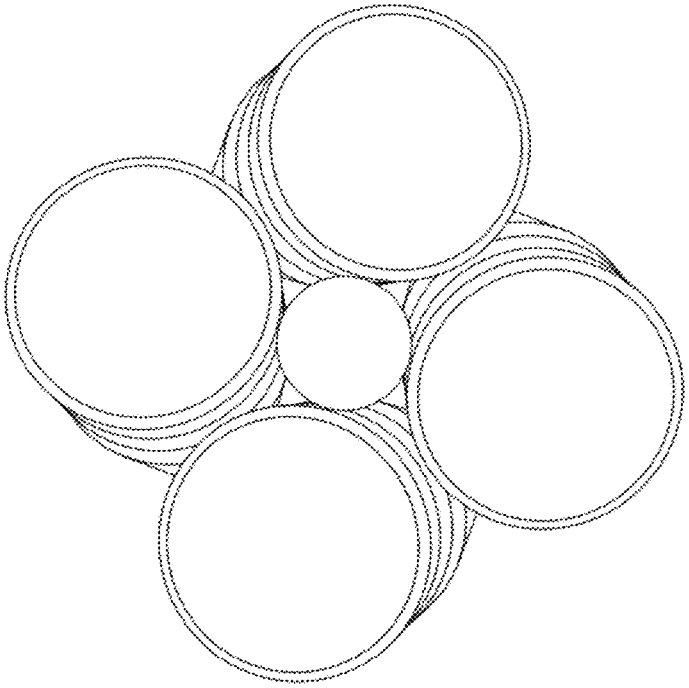
FIG. 2 is a structural schematic diagram of a skew rolling assembly suitable for large-size superalloy bars according to the present disclosure from other angles.
Figure 3:
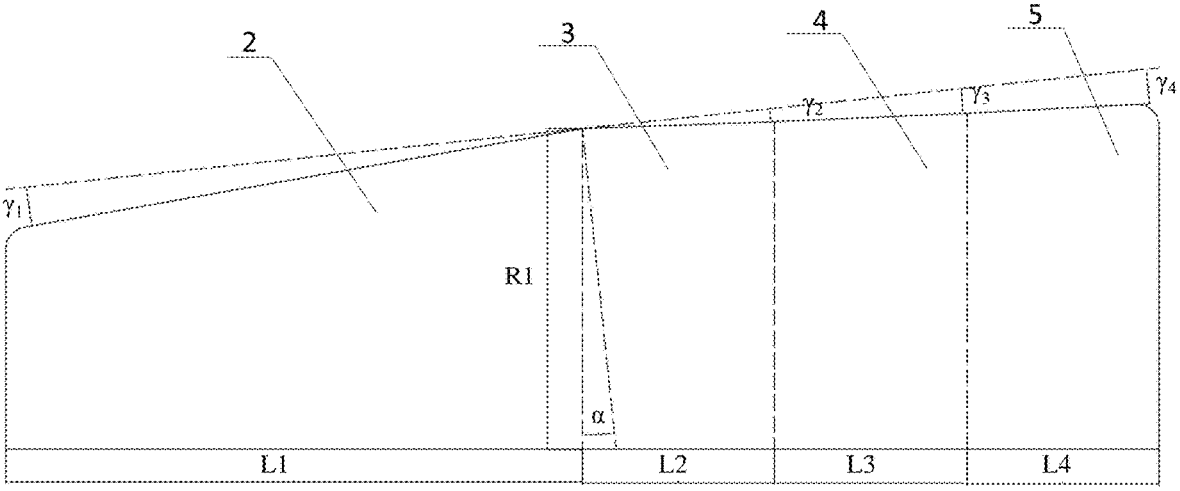
FIG. 3 is a structural schematic diagram of a roller of a skew rolling assembly suitable for large-size superalloy bars according to the present disclosure.
Figure 4:
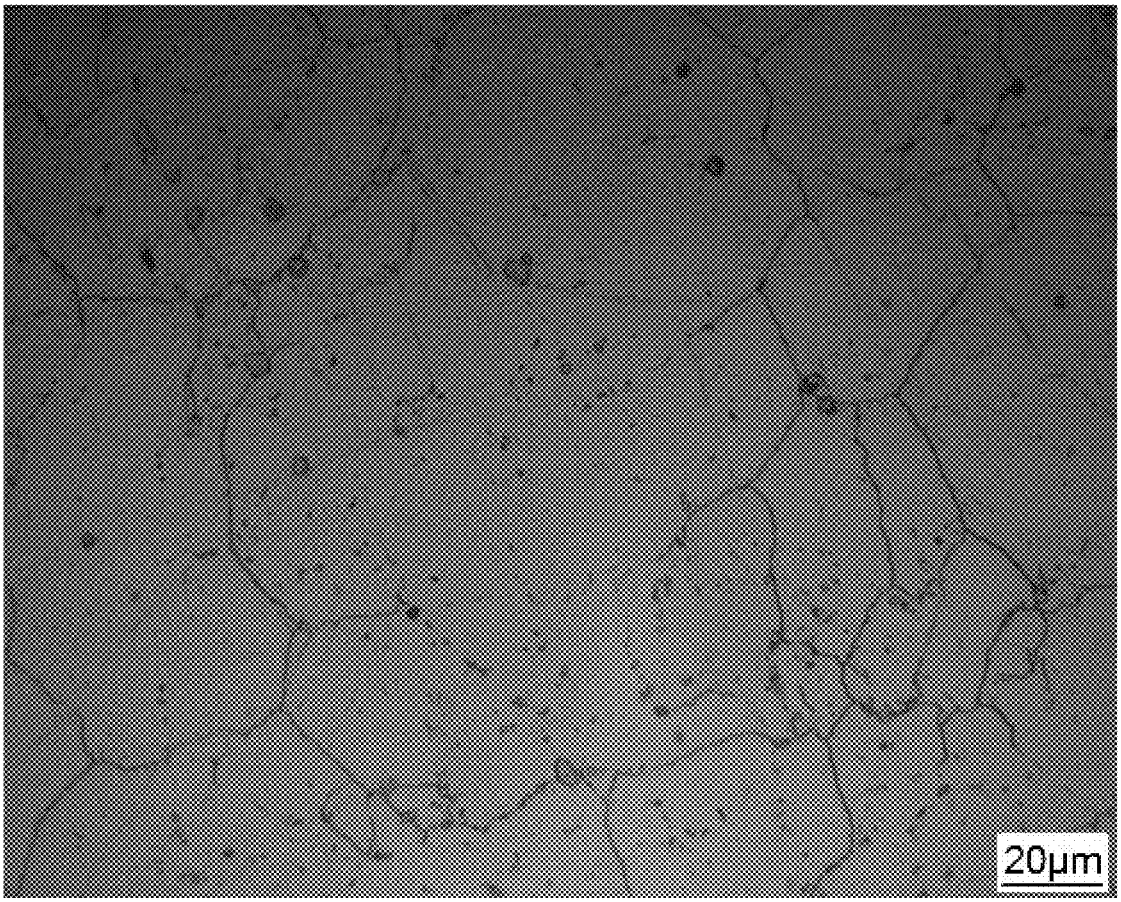
FIG. 4 is a metallographic diagram of a blank before rolling in an embodiment of a skew rolling method suitable for large-size superalloy bars according to the present disclosure.
Figure 5:
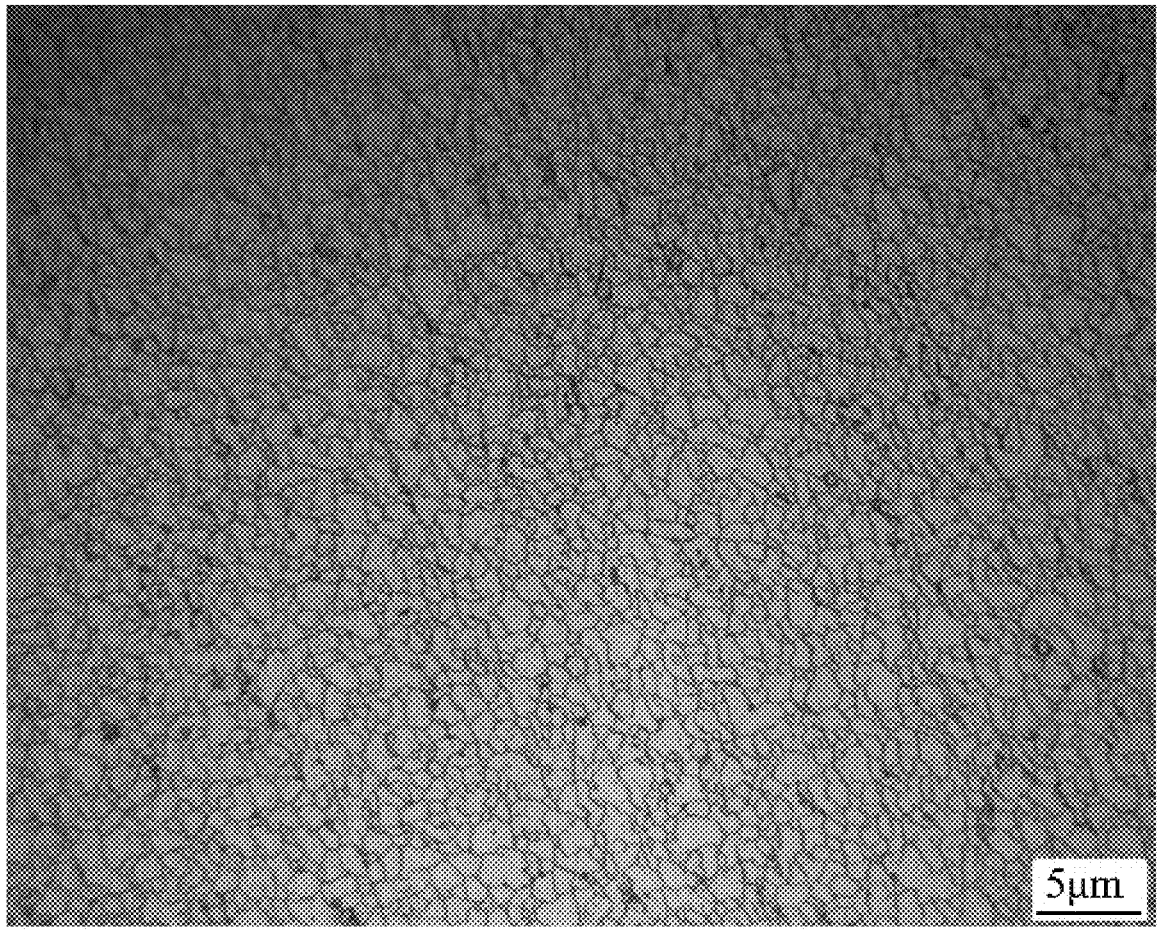
FIG. 5 is a metallographic diagram of a blank after first-pass rolling in an embodiment of a skew rolling method suitable for large-size superalloy bars according to the present disclosure.

Referring from FIG. 1 to FIG. 5, FIG. 1 is a structural schematic diagram of a skew rolling assembly suitable for large-size superalloy bars according to the present disclosure. FIG. 2 is a structural schematic diagram of a skew rolling assembly suitable for large-size superalloy bars according to the present disclosure from other angles. FIG. 3 is a structural schematic diagram of a roller of a skew rolling assembly suitable for large-size superalloy bars according to the present disclosure. FIG. 4 is a metallographic diagram of a blank before rolling in an embodiment of a skew rolling method suitable for large-size superalloy bars according to the present disclosure. FIG. 5 is a metallographic diagram of a blank after first-pass rolling in an embodiment of a skew rolling method suitable for large-size superalloy bars according to the present disclosure.

The skew rolling assembly suitable for large-size superalloy bars provided by the present disclosure includes four rollers 1 capable of rotating actively, where the rollers 1 each are of an unequal-diameter rotary body structure. A straight line where a moving direction of a blank 6 during rolling is located is used as a rolling line, and the four rollers 1 are uniformly distributed around a circumferential direction of the rolling line.

The skew rolling assembly suitable for large-size superalloy bars provided by the present disclosure employs four rollers 1 of the same structure, the four rollers 1 are all active rollers. In the production process, the four rollers 1 play a role in promoting the forward flow of blank 6 metal in a rolling direction, thus avoiding the phenomenon of rolling jamming caused by the obstruction of a guide plate to the forward flow of the blank 6 in the rolling process of the prior art. The providing of the four rollers 1 improves the rolling speed. In addition, by adjusting the rotation directions of the four rollers 1 and the spacing between the rollers 1, multi-pass reciprocating rolling can be achieved, the degree of deformation is increased, and the rolling production efficiency of the large-size superalloy bars is further improved.

The four rollers 1 are of the same structure and size.

In the specific embodiment, the ends having a large diameter of the four rollers 1 are uniformly distributed around the rolling line to form a feed end of the blank 6, as shown in FIG. 1 and FIG. 2.

Specifically, a throat diameter $D_1$ of the roller 1 ($D_1=2R_1$, $R_1$ is the throat radius) and the diameter $D_b$ of the blank 6 satisfy that $D_1/D_b=1.0$ to 5.0, and the body length L of the roller 1 and the throat diameter $D_1$ of the roller 1 satisfy that $L/D_1=3.0$ to 7.0. The roller 1 includes a first truncated cone 2, a second truncated cone 3, a third truncated cone 4 and a fourth truncated cone 5 which are arranged coaxially and connected in sequence. An axial length ratio of the first truncated cone 2 to the second truncated cone 3 to the third truncated cone 4 to the fourth truncated cone 5 is that L1:L2:L3:L4=3:1:1:1. A roller surface cone angle $\gamma_1$ of the first truncated cone 2, a roller surface cone angle $\gamma_2$ of the second truncated cone 3, a roller surface cone angle $\gamma_3$ of the third truncated cone 4 and a roller surface cone angle $\gamma_4$ of the fourth truncated cone 5 are from 3 degrees to 4.5 degrees, from 3 degrees to 4 degrees, from 2 degrees to 3.5 degrees, and from 1 degree to 3.5 degrees, respectively; and a rolling angle $\alpha$ of the roller 1 is from 5 degrees to 7 degrees. In actual production, the size of the four rollers 1 can be adjusted according to the specification of the blank 6 and production requirements, thus improving the flexibility and adaptability of the skew rolling assembly.

It should also be emphasized that the spacing between the four rollers 1 can be adjusted, so as to adjust the specification of a deformation zone according to the bar rolling requirements, and further improve the adaptability of the skew rolling assembly.

More specifically, in a plane perpendicular to the rolling line, a spacing ratio of two pairs of rollers 1 placed in opposite is ellipticity, and the ellipticity in any plane perpendicular to the rolling line in the deformation zone is equal, and the ellipticity is from 1.0 to 1.1. The specification of the deformation zone can be adjusted by adjusting the ellipticity, thus satisfying different rolling requirements.

In addition to that, in the deformation zone, a feeding angle is from 7 degrees to 9 degrees, the rolling angle is from 5 degrees to 7 degrees, the rotating speed of the roller 1 is from 10 r/min to 11 r/min, and the diameter reduction rate is from 60% to 70%. In actual application, operating parameters of the roller 1 can be adjusted according to rolling production requirements.

Further, a skew rolling method suitable for large-size superalloy bars is further provided by the present disclosure, which uses the skew rolling assembly suitable for large-size superalloy bars above. The four rollers 1 all rotate around respective axes, and the heated blank 6 enters the region enclosed by the four rollers 1 for achieving first-pass forward rolling.

It should be noted that after first-pass forward rolling is completed, rotation directions of the four rollers 1 and the spacing between the rollers 1 may be adjusted for the second-pass rolling to further improve the rolling production efficiency. The forward rolling and the reverse rolling are repeated until the rolling is completed, and then the blank 6 is cooled to room temperature by air cooling or water cooling. In specific embodiment, the blank 6 employs superalloy GH4169 having a diameter from 300 mm to 500 mm and a length from 300 mm to 15,000 mm.

It also should be noted that during the heating of the blank 6, the blank 6 can be heated to 915° C. to 1,115° C. in a heating surface, the heating time is T, the unit is min, and $T=D_b\times(0.6\text{-}0.8)$, where $D_b$ is the diameter of the blank 6, and the unit is mm.

In accordance with the skew rolling assembly and method suitable for large-size superalloy bars, four rollers 1 rotating in the same direction are circumferentially and uniformly distributed around the rolling center line at an interval of 90 degrees, and all four rollers 1 are power rollers for promoting the blank 6 metal to flow forward in the rolling direction, which not only solves the problem of rolling jamming caused by the obstruction of guide plates, but also improves the rolling speed. In the rolling process, the blank 6 is only in partial contact with the roller 1, and thus the forming load is low compared with the mainstream severe plastic deformation technology. The spacing between the rollers 1 is adjustable, and the rotation directions of the rollers 1 are adjustable. After the first-pass rolling, the spacing between the rollers 1 and the rotation directions of the rollers can be quickly adjusted, thus making the blank 6 to be subjected to the second pass-rolling in a direction opposite to the direction of the first-pass rolling. Thus, multi-pass reciprocating rolling can be carried out repeatedly, the rolling time is saved, and the rolling production efficiency is further improved. By utilizing the four rollers for skew rolling, on the premise of guaranteeing the smooth completion of the rolling process, the production cost is saved, and the production efficiency is improved.

EXPLANATION OF THE GLOSSARY

Rolling jamming refers to the phenomenon that the blank only rotates but does not advance or neither rotates nor advances in the rolling process.

Ellipticity: ellipticity herein means that in the plane perpendicular to the rolling line, a spacing ratio of two pairs of rollers 1 placed in opposite is ellipticity, and the ellipticity is required to be ≥1. (Specifically, the ellipticity is a value obtained by comparing a spacing value of two opposite rollers 1 having a larger spacing with a spacing value of the other two opposite rollers 1 having a smaller spacing).

Several examples are used for illustration of the principles and implementation methods of the present disclosure. The description of the embodiments is merely used to help illustrate the method and its core principles of the present disclosure. In addition, those of ordinary skill in the art can make various modifications in terms of specific embodiments and scope of application in accordance with the teachings of the present disclosure. In conclusion, the content of this specification shall not be construed as a limitation to the present disclosure.

What is claimed is:

1. A skew rolling assembly suitable for large-size superalloy bars, comprising:

four rollers capable of rotating actively, wherein the rollers each are of an unequal-diameter rotary body structure;

wherein a blank is configured to move in a moving direction along a straight line which is used as a rolling line during rolling, and the four rollers are uniformly distributed around a circumferential direction of the rolling line;

wherein a region enclosed by the four rollers is a deformation zone, and a spacing between opposite rollers of the four rollers is adjustable;

in a plane perpendicular to the rolling line, a spacing ratio of two pairs of rollers arranged at intervals is ellipticity, and the ellipticity in any plane perpendicular to the rolling line in the deformation zone is equal, and the ellipticity is from 1.0 to 1.1;

in the deformation zone, a feeding angle is from 7 degrees to 9 degrees, the rolling angle is from 5 degrees to 7 degrees, the rotating speed of each of the four rollers is from 10 r/min to 11 r/min, and the diameter reduction rate is from 60% to 70%.

2. The skew rolling assembly suitable for large-size superalloy bars according to claim 1, wherein the four rollers have the same size.

3. The skew rolling assembly suitable for large-size superalloy bars according to claim 2, wherein the ends having a large diameter of the four rollers are uniformly distributed around the rolling line to form a feed end of the blank.

4. The skew rolling assembly suitable for large-size superalloy bars according to claim 2, wherein each of the four rollers comprises a first truncated cone, a second truncated cone, a third truncated cone and a fourth truncated cone which are arranged coaxially and connected in sequence; an axial length ratio of the first truncated cone to the second truncated cone to the third truncated cone to the fourth truncated cone is 3:1:1:1, a roller surface cone angle of the first truncated cone is from 3 degrees to 4.5 degrees, a roller surface cone angle of the second truncated cone is from 3 degrees to 4 degrees, a roller surface cone angle of the third truncated cone is from 2 degrees to 3.5 degrees, a roller surface cone angle of the fourth truncated cone is from 1 degree to 3.5 degrees, and a rolling angle of each of the four rollers is from 5 degrees to 7 degrees.

5. The skew rolling assembly suitable for large-size superalloy bars according to claim 4, wherein a ratio of a throat diameter of each of the four rollers to a diameter of the blank is from 1.0 to 5.0, and a ratio of an axial length of each of the four rollers to the throat diameter of the roller is from 3.0 to 7.0.

6. A skew rolling method suitable for large-size superalloy bars, which uses the skew rolling assembly suitable for large-size superalloy bars according to claim 1, the skew rolling method comprising: enabling the four rollers all to rotate around respective axes, heating the blank and enabling the blank after heating to enter the deformation zone enclosed by the four rollers for variable cross-section rolling, thus completing first-pass forward rolling.

7. The skew rolling method suitable for large-size superalloy bars according to claim 6, wherein the four rollers have the same size.

8. The skew rolling method suitable for large-size superalloy bars according to claim 7, wherein the ends having a large diameter of the four rollers are uniformly distributed around the rolling line to form a feed end of the blank.

9. The skew rolling method suitable for large-size superalloy bars according to claim 7, wherein each of the four rollers comprises a first truncated cone, a second truncated cone, a third truncated cone and a fourth truncated cone which are arranged coaxially and connected in sequence; an axial length ratio of the first truncated cone to the second truncated cone to the third truncated cone to the fourth truncated cone is 3:1:1:1, a roller surface cone angle of the first truncated cone is from 3 degrees to 4.5 degrees, a roller surface cone angle of the second truncated cone is from 3 degrees to 4 degrees, a roller surface cone angle of the third truncated cone is from 2 degrees to 3.5 degrees, a roller surface cone angle of the fourth truncated cone is from 1 degree to 3.5 degrees, and a rolling angle of each of the four rollers is from 5 degrees to 7 degrees.

10. The skew rolling method suitable for large-size superalloy bars according to claim 9, wherein a ratio of a throat diameter of each of the four rollers to a diameter of the blank is from 1.0 to 5.0, and a ratio of an axial length of each of the four rollers to the throat diameter of the roller is from 3.0 to 7.0.

* * * * *